United States Patent [19]

Romer et al.

[11] 4,306,502

[45] Dec. 22, 1981

[54] MISSILE HAVING EXPLOSIVE CHARGES WITH PROJECTILE FORMING COVERINGS

[75] Inventors: Rudolf Romer, Kaarst; Hendrik R. Lips, Duesseldorf; Hans Orth, Ratingen; Benjamin Furch, Unterlüss, all of Fed. Rep. of Germany

[73] Assignee: Rheinmetall GmbH, Duesseldorf, Fed. Rep. of Germany

[21] Appl. No.: 67,144

[22] Filed: Aug. 16, 1979

[30] Foreign Application Priority Data

Aug. 16, 1978 [DE] Fed. Rep. of Germany ..... 2835818

[51] Int. Cl.[3] ..... F42B 1/02

[52] U.S. Cl. ..... 102/307; 102/307

[58] Field of Search ..... 102/24 HC, 56 SC, 307, 102/309

[56] References Cited

U.S. PATENT DOCUMENTS

| | | | |
|---|---|---|---|
| 2,442,528 | 6/1948 | Beattie | 102/34.1 X |
| 2,900,905 | 8/1959 | MacDougall | 102/56 SC |
| 3,726,224 | 4/1973 | Pugh et al. | 102/56 SC |
| 3,949,674 | 4/1976 | Talley | 102/56 SC X |
| 4,040,354 | 8/1977 | Stern | 102/56 SC X |
| 4,201,135 | 5/1980 | Nikowitsch | 102/24 HC X |
| 4,222,329 | 9/1980 | Austin | 102/56 SC X |

FOREIGN PATENT DOCUMENTS

| | | | |
|---|---|---|---|
| 2706060 | 8/1978 | Fed. Rep. of Germany | 102/24 HC |

*Primary Examiner*—Peter A. Nelson

[57] ABSTRACT

A load-carrying missile adapted for firing from barrel weapons and having a plurality of explosive charges disposed thereon with a plurality of projectile forming coverings distributed over the periphery of the missile and directed substantially perpendicular to the axis of the missile. The missile is provided with a parachute which is connected to the casing of the missile and which causes a directional braked descent of the missile in the target area.

9 Claims, 6 Drawing Figures

MISSILE HAVING EXPLOSIVE CHARGES WITH PROJECTILE FORMING COVERINGS

BACKGROUND OF THE INVENTION

This application is related to the coassigned application (R 686) of Romer, Lips, and Furch, filed contemporaneously herewith, Ser. No. 067,143 and entitled WARHEAD WITH A PLURALITY OF SLAVE MISSILES.

The invention relates to a missile having a plurality of explosive charges disposed thereon with a plurality of projectile-forming coverings distributed over the periphery of the missile and directed substantially perpendicular to the axis of the missile. The missile is provided with a parachute which is connected to the casing thereof and which causes a directional braked descent of the missile in the target area.

A missile is disclosed in DE-OS No. 22 05 074 (unexamined German patent application) which comprises, apart from projectile-forming coverings, a spike-forming hollow-charge casing and splinterable coverings designed to form preshaped splinters. Such missile is intended to be fired with other similar missiles disposed axially one behind the other in a rocket warhead and to permit a parallel combatting or personnel and mobile or immobile armored targets in the target area.

This known missile is not suitable for firing from barrel weapons, since it cannot withstand the high firing acceleration because of its construction. Furthermore, the performance of the projectile-forming coverings is comparatively low despite the high volume of explosive because such explosive is not adequately dammed and this has to bring into effect a spike-forming hollow-charge casing and splinter coverings as well as the projectile-forming coverings. Against armor targets, the possibility of penetrating armor-plating 35 mm thick is completely inadequate, because armor plating is particularly well protected against a shot from the side or from the front.

It is among the objects of the present invention, while avoiding the disadvantages of the above described known missile, to provide a missile which is simple in construction, which comprises as large a number as possible of highly effective projectile-forming coverings, and which is suitable from firing from a barrel weapon.

Missiles in accordance with the invention have a plurality of explosive charges disposed thereon with a plurality of projectile-forming coverings distributed over the periphery of the missile and directed substantially perpendicular to the axis thereof. The missile is provided with a parachute which is connected to the casing of the missile and which causes a directional braked descent of the missile in the target area. The missile is of disc-shaped construction and is provided with an explosive-charge casing which includes two cover plates each with a central conical depression and with axial range spacers which are formed at least partially by projectile-forming coverings. In preferred embodiments the axial range spacers are formed by a cylindrical shell with openings for the projectile-forming coverings and/or by projectile-forming coverings of rectangular construction. The range spacers, which may be radially disposed, and provided between the explosive charges for the individual projectile-forming coverings. The explosive-charge casing is constructed in the form of a dam for the explosive charges for the projectile-forming coverings. The parachute is disposed in the conical depression in one of the cover plates, and a proximity fuse is disposed in the conical depression of the other cover plate of the missile.

As a result of its disc-shaped construction, the missile according to the invention offers the possibility of disposing a large number of similar missiles, one behind the other in a load-carrying missile, and at the same time of accomodating a large effective amount of explosive. The depressions in the cover plates of the missile permit an advantageous accomodation of the parachute and of the proximity fuse, while through the formation of the depressions and a suitable wall thickness of the individual elements of the missile casing, both a great strength in the axial direction and an excellent damming of the explosive is achieved, so that the projectile-forming coverings are accelerated with the maximum possible energy.

It is particularly advantageous to make the projectile-forming coverings rectangular or square, because as a result the height of the column of explosives situated behind is increased, the projectile-forming coverings can be shifted closer to the periphery of the explosive charge, and because these projectile-forming coverings can contribute additionally considerably to the axial support of the cover plates. Since these projectile-forming coverings with a rectangular or square cross-section can also be formed as pyramids or as cones or of roof-shape, they have a great rigidity of shape so that possibly the cylindrical shell with openings for the projectile-forming coverings can be dispensed with entirely if additional radial range spacers are provided.

Further details and advantages of the invention are apparent from the following description of two embodiments of the missile of the invention which are illustrated in the drawings.

and

Figure 4:
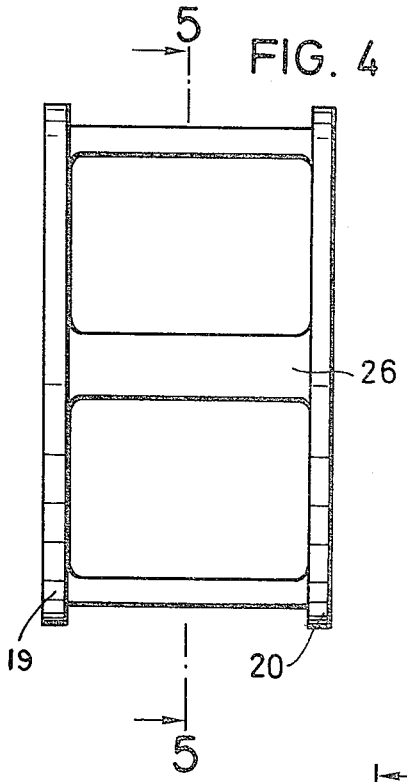
FIG. 4 is a view in side elevation of a second embodiment of the missile of the invention, such missile having rectangular projection-forming coverings.
Figure 6:
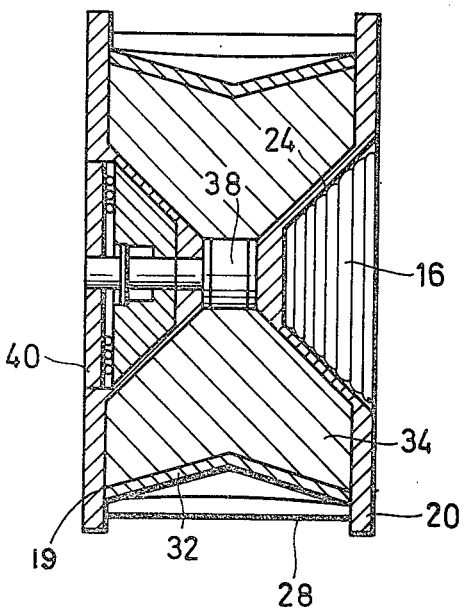
Figure 5:
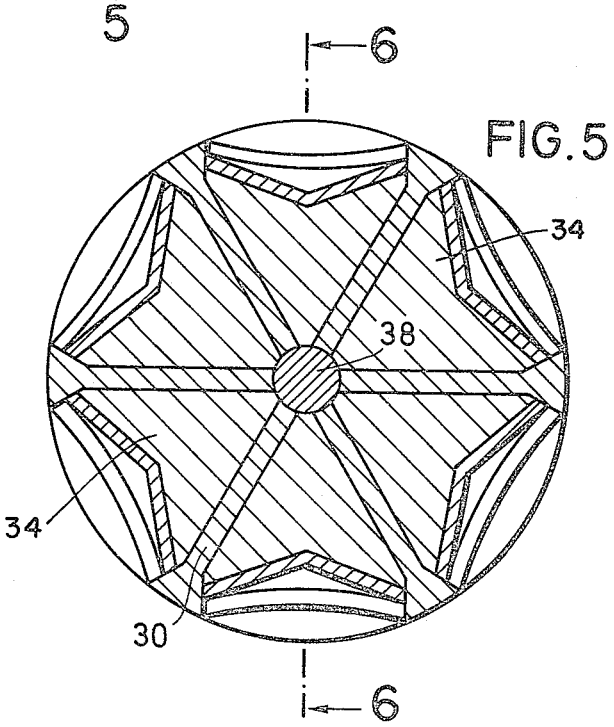
FIG. 5 is a view in transverse section through the missile of FIG. 4, this section being taken along the line 5—5 of FIG. 4.

FIG. 6 is a view in longitudinal axial section through the missile of FIGS. 4 and 5, this section being taken along the line 6—6 of FIG. 5.

DETAILED DESCRIPTION

Figure 1:
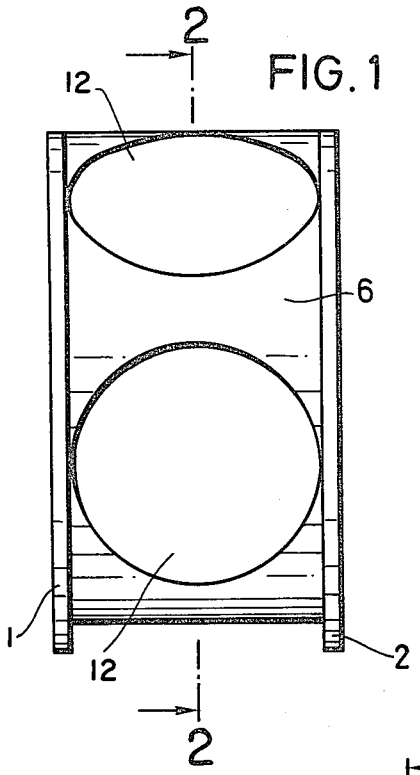
FIG. 1 is a view in side elevation of a first embodiment of missile according to the invention, such missile having circular projectile-forming coverings.
Figure 3:
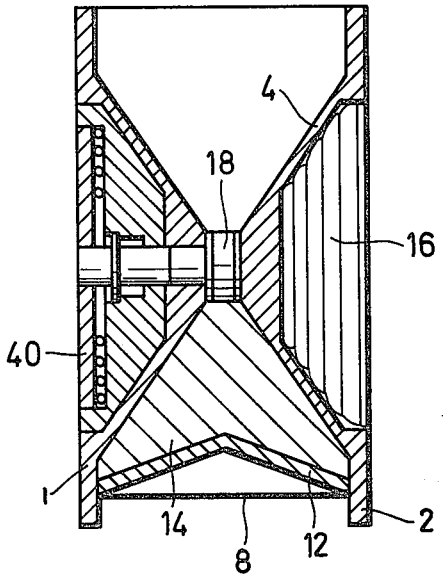
FIG. 3 is a view in longitudinal axial section through the missile of FIGS. 1 and 2, the section being taken along the line 3—3 of FIG. 2.
Figure 2:
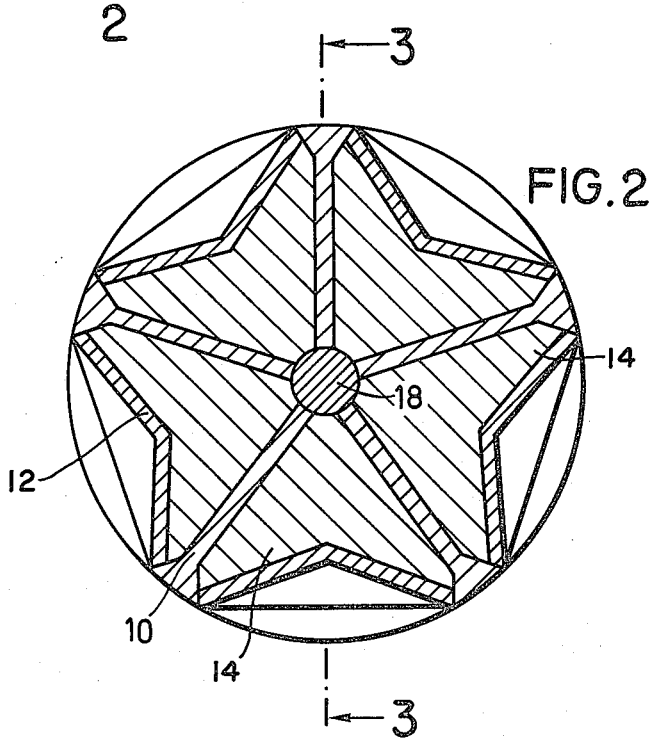
FIG. 2 is a view in transverse section through the missile of FIG. 1, the section being taken along the line 2—2 in FIG. 1.

Turning first to the embodiment of FIGS. 1, 2, and 3, there is shown a missile having a casing or shell having an upper cover plate 2 and a lower cover plate 1, each having an axially inwardly converging conical depression 4, the cylindrical shell 6 being provided with openings 8 to receive projectile-forming coverings 12. Radially disposed range spacers 10 serve for the additional support of the cover plates 1 and 2 against axial loads and form, with the cover plates, means for damming the explosive charges 14 which, on ignition, transform the projectile-forming coverings 12 into individual missiles with high starting speeds, a comparatively large mass, and relatively stable flight characteristics.

The explosive charges 14 are primed by a central transmission charge 18 ignited by a proximity fuse 40 disposed on the lower cover plate 1 when the explosive charge has descended, the missile being oriented and braked by means of a parachute 16 to within ignition distance of 0.5 to 1.5 m above the ground.

The second embodiment of the missile of the invention, shown in FIGS. 4–6, inclusive, differs from that of FIGS. 1, 2, and 3, in that the missile casing comprises a lower cover plate 19 and an upper cover plate 20, each with axially inwardly converging conical depressions 24 and a cylindrical shell 26 with rectangular openings 28 for the reception of rectangular, projectile-forming coverings 32. This enables the projectile-forming coverings 32 to be disposed radially closer to the periphery of the cylindrical shell 26 so that the height of the column of explosive between the projectile-forming coverings 32 and a centrally disposed transmission charge 38 effective for all explosive charges 34 is greater than in the first embodiment of the invention, above described.

As before, a parachute 16 is disposed in the recess in the upper cover plate 20, and a proximity fuse 40 is mounted in the lower cover plate 19.

Since with the same height of the explosive charge and the same mass of the projectile-forming coverings 12 in the first embodiment and 32 in the second embodiment, the projectile-forming coverings 32 can be narrower than the diameter of the circular projectile-forming coverings 12, the larger number of projectile-forming coverings 32 can be disposed at the periphery of the explosive charges. The number of the explosive charges 34 is correspondingly greater, as is also true of the range spacers 30 disposed between the explosive charges 34.

In both of the above-described embodiments of the invention, the disclosed construction of the explosive-charge casing permits a great damming of the explosive charges 12 or 34 to be achieved, and at the same time a high axial rigidity of the explosive charge is achieved so that it withstands the high firing acceleration of the missile from the barrel weapon.

Although the invention is illustrated and described with reference to a plurality of perferred embodiments thereof, it is to be expressly understood that it is in no way limited to the disclosure of such a plurality of preferred embodiments, but is capable of numerous modifications within the scope of the appended claims.

We claim:

1. A missile which can be fired from a barrel weapon, comprising a hollow disc-shaped missile body, a plurality of explosive charges disposed in the missile body with a plurality of projectile-forming coverings for the charges distributed over the periphery of the missile body and directed substantially perpendicularly to the axis of the missile, a parachute connected to the missile body for causing a directional, braked descent of the missile in the target area, the missile being provided with cover plates for the opposite ends of the body, each cover plate having a central axially inwardly converging conical depression, and axial range spacers which are formed at least partially by the projectile-forming coverings, and radially disposed range spacers between the explosive charges for the individual projectile-forming coverings.

2. A missile as claimed in claim 1, said missile being able to be stacked in a barrel weapon and discharged from the weapon one behind the other in a load-carrying missile.

3. A missile as claimed in claim 1, wherein the axial range spacers are formed by a cylindrical shell with openings for the projectile-forming coverings.

4. A missile as claimed in claim 3, wherein the projectile-forming coverings are of rectangular construction.

5. A missile as claimed in claim 3, comprising radially disposed range spacers provided between the explosive charges for the individual projectile-forming coverings.

6. A missile as claimed in claim 1, wherein the range spacers are constructed in the form of supporting elements to transmit the firing acceleration to the missile body.

7. A missile as claimed in claim 1, wherein the projectile-forming coverings are constructed in the form of dams for the explosive charges.

8. A missile as claimed in claim 1, wherein the parachute is disposed in the conical depression in one of the depression plates, and comprising a proximity fuse disposed in the conical depression of the other cover plate.

9. In an improved composite load-carrying projectile having a plurality of explosive bodies arranged in respective housings one behind the other, each of which is provided with a plurality of projectile forming coverings which are disposed substantially perpendicularly to and around the axis of the load-carrying projectile, and further having a parachute mounted in each housing for providing a directional braking of the housing in a target area the improvement comprising (a) two circular cover plates (1, 2, 19, 20) between which there are disposed a plurality of range spacer plates normal to said cover plates (10, 30) which constitute a reinforcement by the spacer plates against axial loading of the housing, each cover plate having a conically shaped depression (4,24), said circular cover plates and spacer plates having radii equal to the caliber radius of the composite projectile;

(b) a plurality of partial explosive amounts (14,34) disposed in the spaces defined between wall portions and said cover plates (2,20) and their depressions (4,24), on the one hand, and range spacer plates (10,30), on the other hand, the exterior openings (8,28) of which are covered by plate-cover forming a projectile which has, in plan view, a configuration selected from a round, square or rectangular configuration and in cross-section a cross section selected from a conical, pyramidical or roof-shaped cross-section (12/32);

(c) a proximity switch (40) disposed in the depression (4,24) of a cover plate (2,20) and a parachute (16) disposed in the other depression (4,24) of the cover plate (2,20); and (d) a transmission charge (38) for all partial explosive amounts (34) which is operatively connected with the proximity switch (40) in the depression (4,24) of a cover plate (2,20).

* * * * *